United States Patent [19]

Morille

[11] 4,189,057

[45] Feb. 19, 1980

[54] DEVICE FOR PACKAGING LIQUID SUCH AS PERFUME

[75] Inventor: Alfred Morille, Neuilly, France

[73] Assignee: Paco Rabanne Parfums S.A., Paris, France

[21] Appl. No.: 963,772

[22] Filed: Nov. 27, 1978

[30] Foreign Application Priority Data

Nov. 28, 1977 [FR] France ..... 77 35786

[51] Int. Cl.[2] ..... B65D 21/02

[52] U.S. Cl. ..... 220/23.4; 215/6; 215/10; 220/23.83; 222/142.3

[58] Field of Search ..... 220/23.2, 23.4, 23.83, 220/23.86; 215/6, 10; 206/430, 527, 429; 222/142.3, 142.5, 142.1, 143, 179.5

[56] References Cited

U.S. PATENT DOCUMENTS

| | | | |
|---|---|---|---|
| 59,333 | 10/1866 | Ballard | 215/6 |
| 997,060 | 7/1911 | Hedrich | 222/142.2 |
| 1,568,160 | 1/1926 | Hibbert | 222/142.3 |
| 2,376,855 | 5/1945 | Hanley | 222/142.3 |
| 2,658,204 | 4/1972 | Bottger | 220/23.4 |
| 4,143,764 | 3/1979 | Moss | 220/23.83 |

*Primary Examiner*—George E. Lowrance
*Attorney, Agent, or Firm*—Bacon & Thomas

[57] ABSTRACT

The invention relates to a device for packaging liquid comprising two coupled bottles mounted on a common base. The two bottles are clipped on the base by means of two tongues on said base between which are inserted said bottles, a locking bead being provided on the inner face of each tongue and cooperating with a recess provided on the adjacent face of each bottle; two guide ribs are provided on said inner face of each tongue to cooperate, each, with a groove of corresponding section provided on the adjacent face of a corresponding bottle. The invention is more particularly applicable to the packaging of perfume.

5 Claims, 4 Drawing Figures

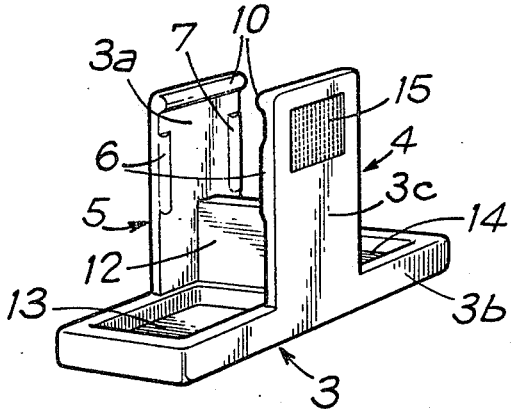
FIG. 3
FIG. 4
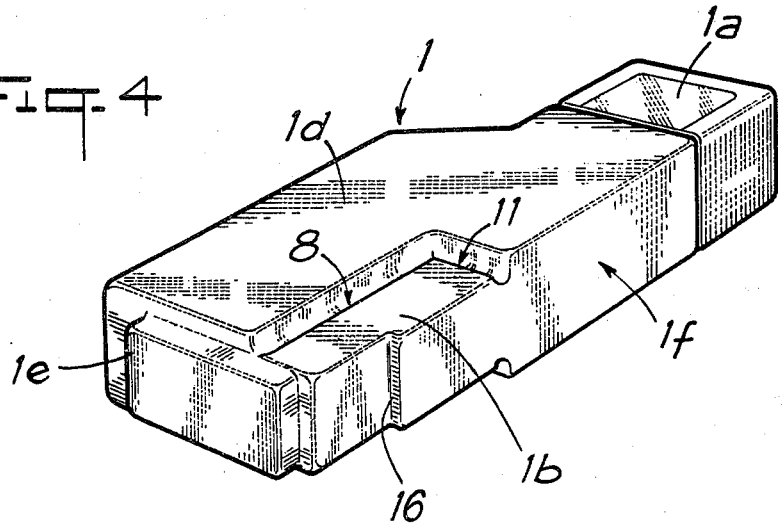

DEVICE FOR PACKAGING LIQUID SUCH AS PERFUME

BACKGROUND OF THE INVENTION

The present invention relates to a device for packaging liquid, of the type comprising two coupled bottles, mounted on a common base.

FIELD OF THE INVENTION

It is a particular object of the invention to propose a device enabling the bottles to be easily handled.

SUMMARY OF THE INVENTION

This purpose is attained, according to the invention, in that the bottles are clipped on the base by means of two tongues on said base, between which each of said bottles is inserted, each bottle being in contact with each of said tongues, a locking projection being provided on the inner face of each tongue to cooperate with a recess provided on the adjacent face of each bottle and two guide elements are provided on said inner face of each tongue to cooperate, each, with a recess provided on the adjacent face of a corresponding bottle, these guide elements and the corresponding recesses being especially arranged and designed to guide the bottles with respect to the base along a path terminating in a final position of said bottles, for which these bottles are both clipped on the base by the cooperation of the locking projections with the corresponding recesses, and rest on the base.

Due to the simultaneous presence of these locking projections and these guide elements each cooperating with a respective recess of the bottles, the assembly of said latter on the base is facilitated and their locking in clipped position is reinforced.

The tongues advantageously extend from a substantially horizontal portion of the base, on which portion the bottles rest in clipped position.

The locking projection of a tongue is advantageously a bead provided along the extreme free edge of said tongue.

The guide elements of a tongue are advantageously provided along the two opposite free edges of the tongue, said edges going from the extreme edge of the tongue up to the horizontal portion of the base.

The guide elements are advantageously ribs and the recesses cooperating with the guide ribs are grooves of section corresponding to that of said ribs.

BRIEF DESCRIPTION OF THE DRAWINGS

FIG. 3 is a view in perspective of the base of the device according to an embodiment of the invention; and FIG. 4 is a view in perspective of a bottle of the device according to an embodiment of the invention.

DESCRIPTION OF THE PREFERRED EMBODIMENT

Figure 1:
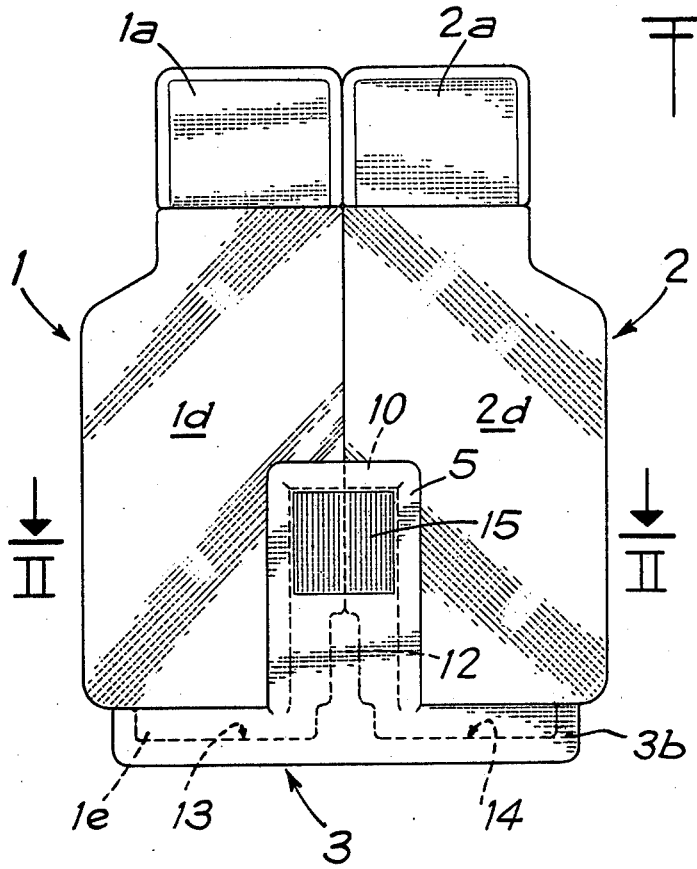
FIG. 1 is an elevational view of a device according to an embodiment of the invention.
Figure 2:
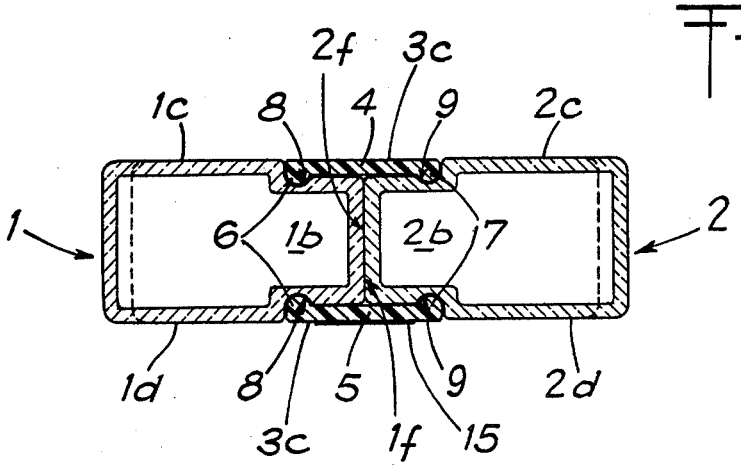
FIG. 2 is a section along II—II of FIG. 1.

As may be seen in the drawings, the device for packaging liquid according to the invention comprises two symmetrical bottles 1 and 2 each provided with a stopper 1*a*, 2*a*. Each bottle 1, 2, of substantially flat form, may be clipped on a common base 3; to this end, a thinner portion 1*b*, 2*b* of each bottle 1, 2 is inserted in the space between two identical vertical tongues 4, 5 of the base 3; this insertion is facilitated by the presence of two beads 6, 7—or guide ribs—of vertical axis, provided on the inner face 3*a* of each tongue 4, 5—i.e. the face turned towards the other tongue 5, 4—along the two vertical edges of this tongue; each bead 6, 7 cooperates with a corresponding groove 8, 9 in a bottle 1, 2 (FIG. 2). A locking bead—or rib—10 is provided on the upper edge of said inner face 3*a* of each tongue 4, 5; this bead 10 is adapted to cooperate with a corresponding groove 11 provided on each large face 1*c*, 1*d* and 2*c*, 2*d* of each bottle, 1 and 2 respectively. The grooves 8, 9 are downwardly open; the grooves 11 of each bottle 1, 2 are substantially half the length of the locking rib 10.

The tongues 4, 5, of rectangular form, extend from a substantially horizontal portion 3*b* of the base 3 and they are also connected to each other over a part of their height and to portion 3*a*, via a vertical partition 12 perpendicular to said tongues 4, 5 and to portion 3*b* at their centres; the partition 12 is shorter than tongues 4, 5, for example is half their height.

Each bottle 1, 2 presents at its bottom end a projecting portion 1*e*, 2*e*, parallelepipedic in form and of small height and of section, through a horizontal plane, smaller than that of said bottle 1, 2, this portion being adapted to be engaged and housed, with small clearance, in a cavity 13, 14, of corresponding form and upwardly open, of portion 3*b* of the base 3.

The elements 6 to 11 and 1*e*, 2*e*, 13 and 14 are shaped and dimensioned so that the two bottles 1 and 2 rest on portion 3*b* of the base 3 when they are clipped on said base 3, the beads 6, 7 and 10 being housed in the corresponding grooves 8, 9 and 11; in this clipped position, the two bottles 1 and 2 are coupled and in contact with each other by their face of smallest width and longest length 1*f*, 2*f* and substantially over the whole length of this face.

The outer face 3*c* of the tongues 4, 5 is advantageously used for receiving a commercial mark 15 characteristic of the liquid (perfume or toilet water) contained in the bottles 1, 2 (FIG. 3).

The thinner portions 1*b*, 2*b* are advantageously dimensioned so that, once the bottles 1 and 2 are clipped on the base 3, the outer face of each tongue 4, 5 is flush with the adjacent large faces 1*d*, 2*d* and 1*c*, 2*c*, respectively, of the bottles 1, 2.

Finally, a shoulder 16 is provided on each face 1*f*, 2*f* of the bottles 1 and 2, to enable the partition 12 of the base 3 to be housed.

The base 3 comprising the elements 3*a*, 4, 5 and 12 is advantageously made of moulded or injected plastics material, in one piece.

What is claimed is:

1. In a device for packaging liquid, of the type comprising two coupled bottles mounted on a common base, the bottles are clipped on the base by means of two tongues thereon between which are inserted each of said bottles, each bottle being in contact with each of said tongues; a locking projection being provided on the inner face of each tongue to cooperate with a recess provided on the adjacent face of each bottle, and two guide elements are provided on said inner face of each tongue which each cooperate with a recess provided on the adjacent face of a corresponding bottle, these guide elements and the corresponding recesses being especially arranged and designed to guide the bottles with respect to the base in a path terminating in a final position of said bottles, for which these bottles are both clipped on the base by the cooperation of the locking projections with the corresponding recesses, and rest on the base.

2. The device of claim 1, wherein the tongues extend from a substantially horizontal portion of the base, on which portion the bottles rest in clipped position.

3. The device of claim 2, wherein the locking projection of a tongue is a bead provided along the extreme free edge of said tongue.

4. The device of either of claims 2 or 3, wherein the guide elements of a tongue are provided along the two opposite free edges of the tongue, said edges going from the extreme edge of the tongue to the horizontal portion of the base.

5. The device of claim 1, wherein the guide elements of a tongue are ribs and the recesses cooperating with these guide ribs are grooves of section corresponding to that of said ribs.

* * * * *